United States Patent [19]

Fischer

[11] 4,294,289

[45] Oct. 13, 1981

[54] FLOW CONTROL DEVICE

[75] Inventor: Armin O. Fischer, Louisville, Ky.

[73] Assignee: American Standard Inc., New York, N.Y.

[21] Appl. No.: 114,818

[22] Filed: Jan. 24, 1980

[51] Int. Cl.[3] ..... F15D 1/02

[52] U.S. Cl. ..... 138/44; 239/590.3

[58] Field of Search ..... 239/590.3, 596, 552, 239/494, 496, DIG. 18; 138/44; 261/DIG. 22

[56] References Cited

U.S. PATENT DOCUMENTS

| | | | |
|---|---|---|---|
| 644,171 | 2/1900 | Handler | 138/44 |
| 2,717,772 | 9/1955 | Palivos | 239/DIG. 18 |
| 2,744,738 | 5/1956 | Hjulian | 239/DIG. 18 |
| 3,608,832 | 9/1971 | Hughes | 239/596 |
| 3,664,589 | 5/1972 | Jatho et al. | 239/428.5 |
| 3,684,191 | 8/1972 | Shames et al. | 239/DIG. 18 |

*Primary Examiner*—John W. Shepperd

*Attorney, Agent, or Firm*—Robert G. Crooks; John P. Sinnott; James J. Salerno, Jr.

[57] ABSTRACT

The invention is directed to a non-clogging flow restrictor for use in a faucet. The flow restrictor is slotted with the sides of the narrow slots either parallel to each other or divergent from each other relative to the entrance side of the respective slot. However, the length of the slots on the entrance side is considerably longer than the length of the slots on the exiting side of the restrictor. Because of this, the invention can tolerate a substantial collection of particles at the leading or flow entry edges of the slot or slots without affecting the designed flow rate.

2 Claims, 5 Drawing Figures

TESTED WITH "HERITAGE" FITTING

FITTING: FULL FLOW, EVEN MIX
WATER PRESSURE: 45 PSI

FLOW CONTROL DEVICE

This invention relates to flow restriction devices and, more particularly, to a disc-shaped flow restrictor that has slots which prevent particulate matter from undesirably blocking flow through the restrictor, and the like.

Quite often flow restrictors are inserted in water faucet nozzles to control the volume and intensity of the fluid or liquid that flows through the faucet, as well as to assist in generating beneficial aerating turbulence.

Frequently, these flow restrictors have an annular shape. Flow from the faucet is channeled through the central aperture producing the desired turbulence and flow rate control. Often, however, this design is unsatisfactory because the flow through the aperture generates a great deal of noise. This undesirable noise is eliminated, or at least reduced to a large extent, through the substitution of a number of smaller holes for the one central aperture in an otherwise impermeable disc. This construction significantly reduces the noise and, in this respect, provides a more acceptable device. These smaller holes, however, are frequently obstructed by sand, rust particles, and the like, that are entrained in the flowing water. The frequency with which these smaller holes become obstructed depends on the turbidity of the water which, eventually, reduces flow volume and, ultimately terminates the flow through the faucet nozzle.

In these circumstances, it often is necessary to remove the flow restrictor from the faucet nozzle and cleanse the restrictor by washing out the particulate matter that is lodged in the small holes. In this respect, some of the small holes become permanently clogged, requiring that the flow restrictor be replaced. This burdensome detail of household maintenance often has an unsettling personal effect because it is a graphic illustration of the quality of the household water supply.

Clearly, there is a need for improvement in this relatively commonplace device.

These, and other problems that have characterized the prior art are overcome to a large extent through the practice of the invention. Typically, a disc is provided with a centrally disposed boss that protrudes in an upstream direction relative to the base of the disc from which it is formed. The boss, moreover, is provided with one or a number of slots, the respective sides of each of these slots being parallel with each other or divergent from each other relative to the upstream side of the disc. These slots, moreover, each are connected with a respective aperture to establish a path for fluid flow through the restrictor. However, the length of the slots on the upstream side should be longer than the length of the aperture.

Because of this unique combination of slots, apertures, and disc configuration, particles will be trapped along the leading or upstream edges of the respective slots. In these circumstances, the slots each must become almost completely obstructed before the total flow through the disc is reduced. Consequently, for a given degree of fluid turbidity, a flow restrictor embodying principles of the invention will permit undiminished flow for a much longer period of time than flow restrictors with smaller holes. This device is further provided with the same relatively noiseless operation as that which has characterized the operation of the smaller, multiple hole flow restrictors in the prior art. It also has been found that radially disposed slots generally are not permanently obstructed but often can be fully cleansed and restored to operation.

For a more complete appreciation of the invention, attention is invited to the following detailed description of a particular embodiment of the invention. The scope of the invention, however, is limited only by the claims.

BRIEF DESCRIPTION OF THE DRAWINGS

As shown in FIG. 1, a disc 10 has a protruding boss 11 in which radially disposed slots 12, 13, 14 (FIG. 2) are formed. As shown in FIG. 2, the slots 12, 13 and 14 each respectively have widths that are substantially smaller than the radial length of the associated slot and are narrow enough to prevent foreign matter from entering the device. The individual slots each, moreover, have sides that are parallel with each other, as shown in the drawing, or diverge from each other (not shown) relative to the surface of the boss 11.

FIG. 3 shows the penetration of the slot 14 through the boss 11 to establish fluid communication from the upstream side of a typical household water faucet (not shown) and the downstream side of the disc 10. As illustrated, the length of the leading or upstream edge of the disc 10 is considerably longer than the length of the aperture 15, which provides the penetration through the disc 10 for the slot 14. This relationship enables the leading edge to accumulate particulate matter without having this matter obstruct the passage of fluid through the aperture.

The disc 10, also has a stepped, recessed interior through which water flows from the slots 12, 13 and 14 in order to discharge through the faucet nozzle (not shown).

Figure 1:
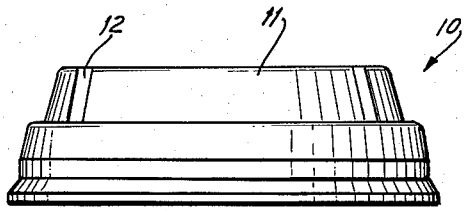
FIG. 1 is a side elevation of a typical flow restrictor that characterizes the invention.
Figure 2:
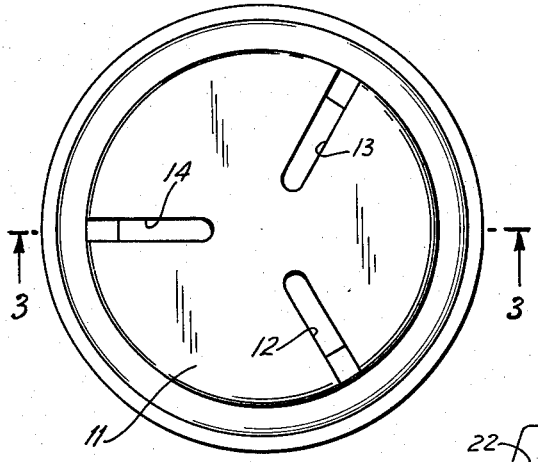
FIG. 2 is a plan view of the flow restrictor that is shown in FIG. 1.
Figure 3:
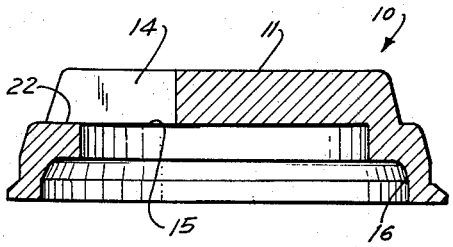
FIG. 3 is a front elevation in full section of the flow restrictor that is shown in FIG. 2 taken along the line 3—3 and viewed in the direction of the arrows.
Figure 4:
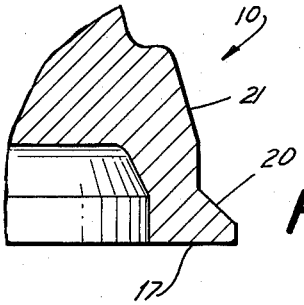
FIG. 4 is a front elevation in full section of a detail of the restrictor that is illustrated in FIG. 3.

In order to enable the disc 10 to fit properly within conventional household and industrial faucet nozzles, the disc 10, as shown in FIG. 4, has an annular base 17. A series of external sides 20 and 21 of the disc 10 are formed above the base 17, these sides sloping inwardly and being stepped toward the center of the disc 10 in an upstream direction. These sloping sides 20 and 21 enable the disc 10 to be inserted or snapped into place within the end of a faucet and to sustain the water pressure that bears upon the boss 11.

In operation, water under ordinary household hydrostatic pressure flows through the slots 12, 13 and 14 in order to discharge from the water faucet (not shown). Because the entrances of the slots 12, 13 and 14 are longer than the respective slot apertures particulate matters will be deposited along the leading edges of the slots, without entering the slots. In this way, the actual apertures 15 in the disc 10 are not obstructed by particulate matter. Consequently, unimpeded flow is provided through the disc 10 until the individual slot entrances are almost entirely blocked before flow is terminated.

In general, the slots 12, 13 and 14 must be longer than the restricting aperture area.

Figure 5:
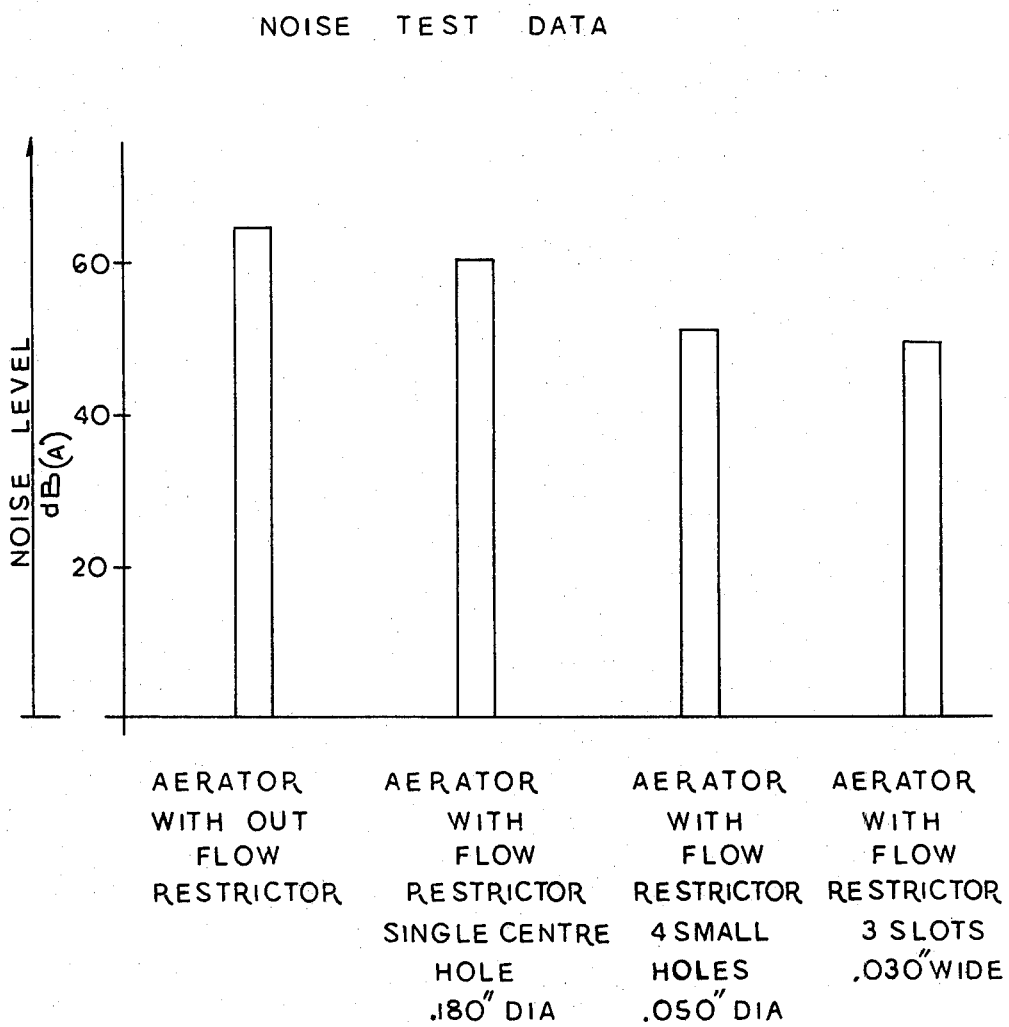
FIG. 5 is a bar chart that illustrates comparative aerator and flow restrictor noise test results.

With these structural features, free flow is maintained through the flow restrictor for a significantly greater period of time than that which has been possible in prior art devices. This flow is achieved, moreover, in a largely noise-reduced manner as indicated in FIG. 5. Thus, the test data for a device that characterizes the invention "Aerator With Flow Restrictor 3 Slots" generates a slightly lower noise level than the four small hole flow restrictor and a substantially lower noise level than the remaining two aerator configurations under test.

I claim:

1. A flow restrictor comprising a disc having a recessed downstream side and a boss formed on the upstream side thereof to form a rim, the upstream surface of said boss being flat, said boss having at least one slot formed therein, the upstream opening of said slot having a respective width that is substantially smaller than the length of said opening, said width being very narrow to prevent foreign matter from entering said slot, said slot having sides within the device, said slot having an aperture formed therein to permit fluid communication between said upstream and downstream disc sides, said aperture at said downstream side being at no point narrower than the narrowest portion of said upstream slot width, and the upstream side of the slot having leading edges that are substantially longer than those of said aperture due to a portion of the slot being obstructed by said rim.

2. A flow restrictor, according to claim 1, wherein said leading edge collects particulate matter without reducing the flow rate until said slot is almost completely obstructed with the particulate matter.

* * * * *